US005093945A

United States Patent [19]

Schoonover et al.

[11] Patent Number: 5,093,945

[45] Date of Patent: Mar. 10, 1992

[54] BABY CRIB WITH SLIDABLE GATE

[76] Inventors: Carleton M. Schoonover; Florence M. Schoonover, both of 1925 W. Lake Dr., Burlington, N.C. 27215

[21] Appl. No.: 712,398

[22] Filed: Jun. 10, 1991

[51] Int. Cl.[5] ..... A47D 7/02; A47D 7/03

[52] U.S. Cl. ..... 5/100

[58] Field of Search ..... 5/93.1, 94.1, 100; 256/25

[56] References Cited

U.S. PATENT DOCUMENTS

| | | | |
|---|---|---|---|
| 2,689,960 | 9/1954 | Lax | 5/93.1 |
| 3,590,403 | 7/1971 | Mixon | 5/100 |
| 3,649,973 | 3/1972 | Benoit et al. | 5/100 |
| 3,900,907 | 8/1975 | Mulder | 5/100 |
| 4,703,524 | 11/1987 | Brunner et al. | 5/93.1 |
| 4,715,074 | 12/1987 | Wallace et al. | 5/93.1 |
| 4,882,799 | 11/1989 | Shapiro | 5/100 |
| 4,924,539 | 5/1990 | Benoit | 5/100 |

FOREIGN PATENT DOCUMENTS

| | | | |
|---|---|---|---|
| 546053 | 6/1942 | United Kingdom | 256/25 |

*Primary Examiner*—Alexander Grosz

[57] ABSTRACT

A full size baby crib of novel construction which provides a range of vertical mattress positions about double those available in existing standard cribs for the dual purpose of safety and convenience. The construction comprises two balcony type modules at each end of the crib which are cantilevered from four generally upright inboard posts. On the side of the crib containing the gate, the two inboard posts are stabilized and made rigid by a plurality of stabilizers which are all functional parts of the crib. This permits a gate of about one-half of the standard width to move vertically from the top rail to the floor.

3 Claims, 5 Drawing Sheets

BABY CRIB WITH SLIDABLE GATE

BACKGROUND—FIELD OF INVENTION

The functional design of full size baby cribs manufactured in quantity has not changed in 30 years—perhaps longer. The aesthetics change but not the function fundamentals: mattress vertical adjustment and for each mattress position, the gate up and gate down protections. These are important because, unlike adults, babies grow while they are using the crib.

BACKGROUND—DESCRIPTION OF PRIOR ART

The reason the function fundamentals have not changed, and that in function they are all about the same, derives from the difficulty in stabilizing the fourth side of a rectangle in which a gate must move vertically. FIG. 1 is a plan view of any crib with a gate.

This difficulty has caused cribs to be very standard with almost identical function fundamentals. They all have four upright posts at the outside corners, one or two full width gates from end to end which slide vertically on a rod, a gate lock under the mattress, one or two stabilizing bars from end to end, and many springs and stops to protect fingers at the top rail and feet at the floor. The gates are all about 50 inches wide which is necessary for stabilization of the fourth side but not for placing babies 12 to 35 inches long in the crib.

There are construction designs other than the standard, of course, but they have not offered advantages sufficient to find their way into significant manufacture.

This standard design has worked for many years but it wastes space that could be used to improve its function. FIG. 2 shows why the space is wasted. The wasted space restricts the vertical mattress adjustment to about 9 inches if proper gate up and gate down protections are maintained. This small amount of adjustment imposes limitations on the convenience and safety of today's standard crib.

SUMMARY OF THE INVENTION

The 26-36 Crib is the same length, width, height and weight as today's standard crib but it recaptures the wasted space that presently exists at the top and bottom of a crib due to the fact that the drop side gate slides on a rod in standard cribs. The space recaptured is used to provide superior function from the standpoint of parent convenience and baby safety.

The construction comprises two balcony-type modules at each end which are cantilevered from four upright posts, located inboard instead of at the four outside corners. The posts are moved inboard along lines defining the two long sides of the crib. On the side of the crib with the gate, the inboard posts are made rigid by a plurality of stabilizers, each of which performs another function in the crib. This permits a gate of about one-half the standard width to move vertically from the top rail to the floor with no attachment to the crib.

Use of the previously wasted space permits about 17 inches of vertical mattress adjustment, versus about 9 inches in standard cribs, and permits use of a gate higher in its vertical dimension of about 31½ inches, versus about 28 inches for standard cribs, to provide proper gate up and gate down protections for the increased range of vertical mattress positions.

This increased mattress adjustment is used in two ways. First, for a newborn just home from the hospital, when the mattress needs to be in its highest position, the top of the mattress in its highest position is about 36 inches from the floor, versus about 30 inches in standard cribs. This is a back-saver for parents because newborns go in and come out in a horizontal attitude.

The second way the 26-36 Crib uses the increased vertical adjustment is when the baby begins to stand up in the crib and the mattress should be in its lowest position. It provides about 26 inches from the top of the mattress in its lowest position to the top of the rails, versus about 20½ inches in standard cribs. This extra height becomes an important safety consideration when the baby begins to stand inside the crib. The Consumer Products Safety Commission says most crib accidents are caused by the baby falling to the floor over the top rails.

REFERENCE NUMERALS IN DRAWINGS

| | |
|---|---|
| 16 balcony type module | 23 mattress support |
| 17 module top rail | 24 stop |
| 18 module bottom rail | 25 gate guide |
| 19 stile | 26 gate slide |
| 20 dowel pin lock | 27 foot protector |
| 21 post | 28 gate |
| 22 dowel pin | 29 gate handle |

PREFERRED EMBODIMENT OF THE INVENTION

Figure 4:
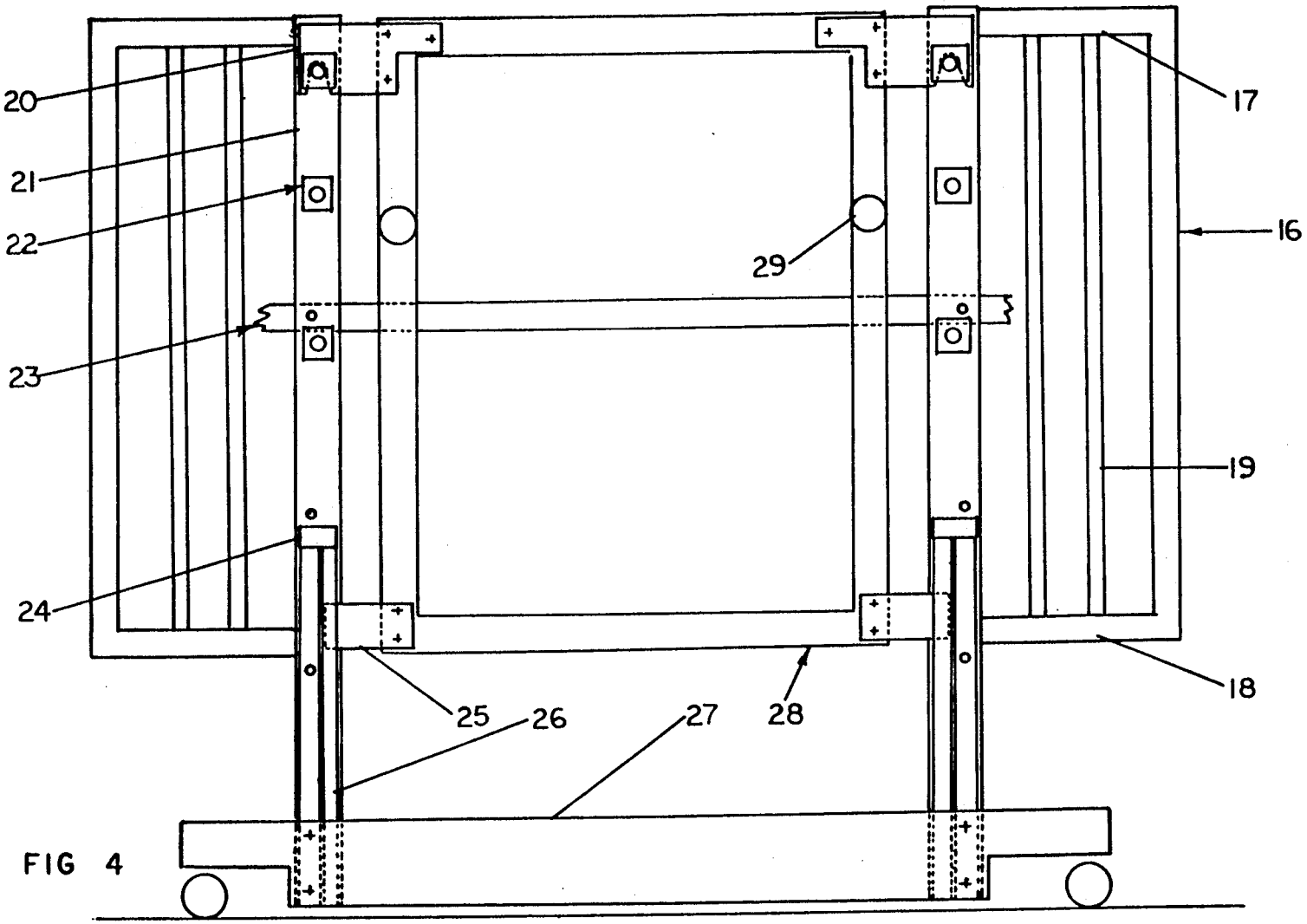
FIG. 4 shows the elevation view, 26-36 Crib.

FIG. 4 shows an elevation of the front side of the crib. The construction comprises two balcony-type modules, 16, at each crib end. The modules have on all three sides a toprail, 17, a bottom rail, 18, connected by stiles, 19, and no floor, bottom, or any means of mattress support. The modules support no weight other than their own and are used only for containment.

These modules, 16, are cantilevered from four upright posts, 21, which are moved inboard from the four outside corners and are in the lines defining the two long sides of the crib.

Figure 6:
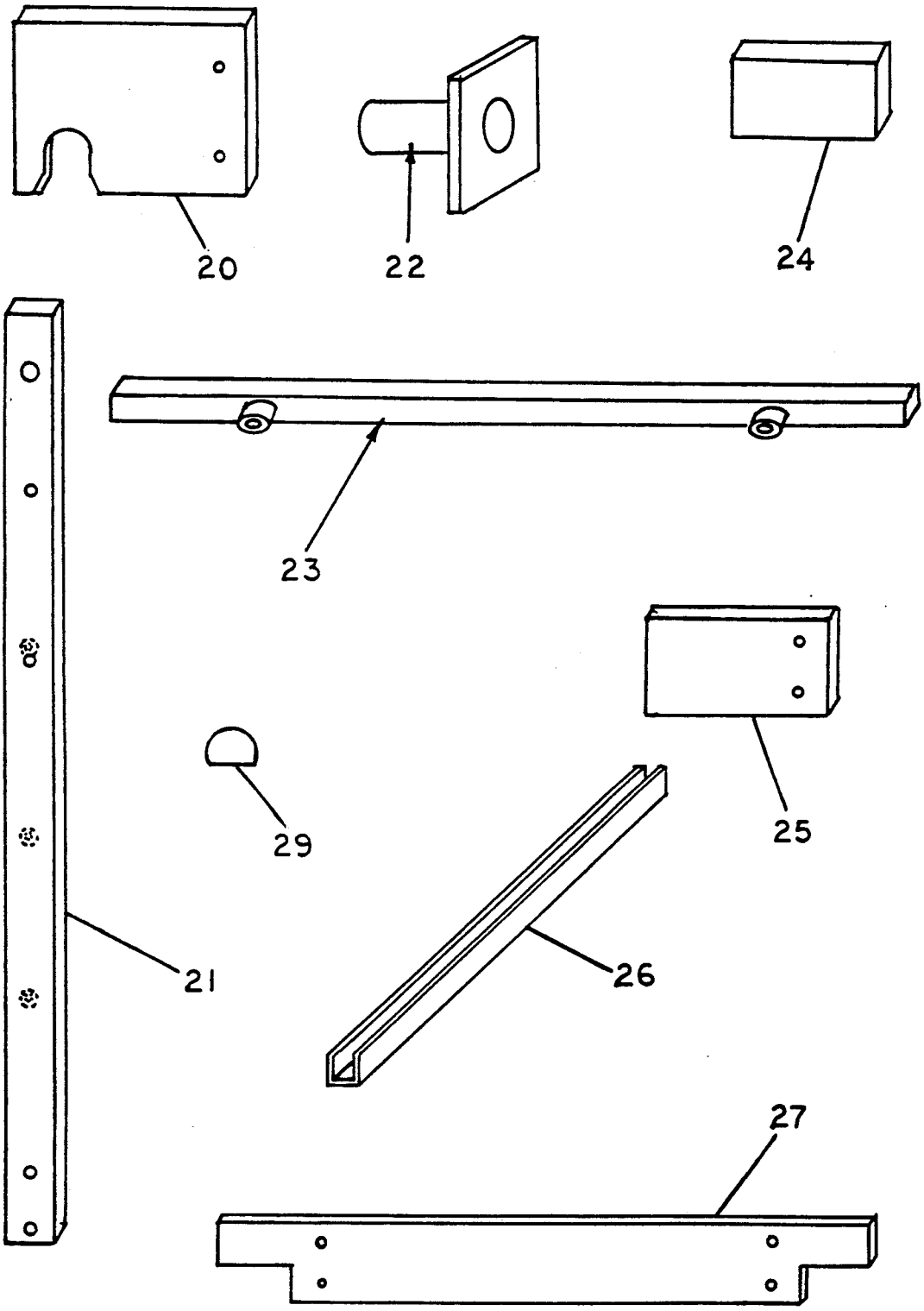
FIG. 6 shows the functional parts, 26-36 Crib.

Each front post, 21, serves as a means for rigidly attaching one-half of the gate lock, 22, in three locations. The gate lock is shown in FIG. 6. All four posts contain holes as a means of rigidly attaching the mattress support, 23, in three horizontal positions with carriage bolts. This method of attachment will meet the requirements of the Canadian government's tests for mattress support systems.

The back wall (not shown) between the posts is identical in construction to the cantilevered modules, 16, with a top rail, a bottom rail and stiles.

Figure 1:
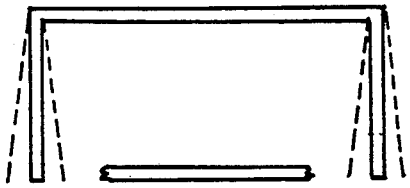
FIG. 1 PRIOR ART
FIG. 1 shows a plan view of any crib with a gate in one side.
Figure 2:
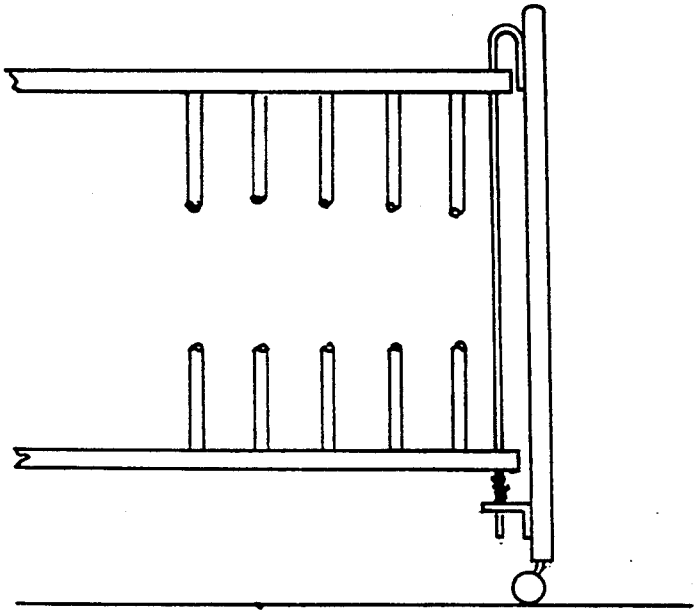
FIG. 2 PRIOR ART
FIG. 2 shows the elevation view illustrating the wasted space in today's standard crib.
Figure 3:
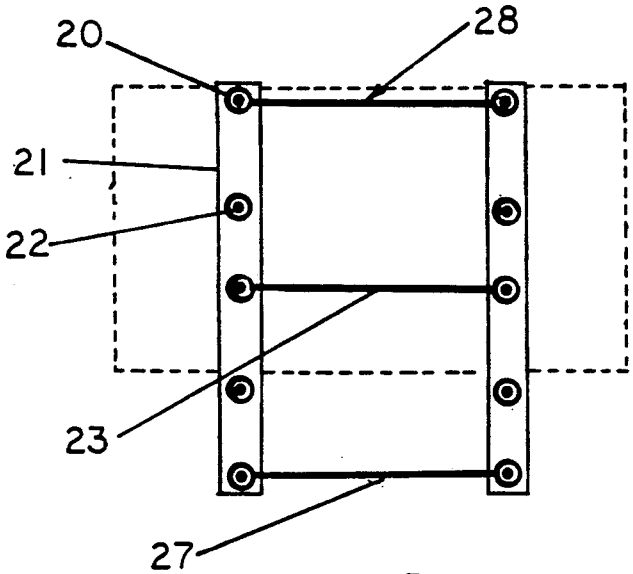
FIG. 3 is a schematic of post stabilizers employed in 26-36 Crib.

The two posts on the front, 21, are made rigid by a plurality of stabilizers, each of which performs another function in the crib. The stabilizers are shown in schematic form in FIG. 3:

(a) Both front posts, 21, are secured at the toprail with dowel pin locks, 20, 22, where 22 is part of the post and 20 is part of the gate, 28. They are locked when the gate is in any of its three fixed positions. They are unlocked only when the gate is being moved.

(b) All four posts are rigidly attached to the mattress support, 23, in each of its three horizontal positions, High, Medium, Low.

(c) Both posts, 21, are rigidly attached to the foot protector, 27, in its one fixed position near the floor.

Between the posts, 21, on the front of the crib is a gate, 28, which is about one-half the width of standard crib gates. It is manually operated by means of two handles, 29, which must be raised about two inches to unlock and, as none of the above stabilizers will interfere, it can go through the previously wasted space to touch the floor.

Figure 5:
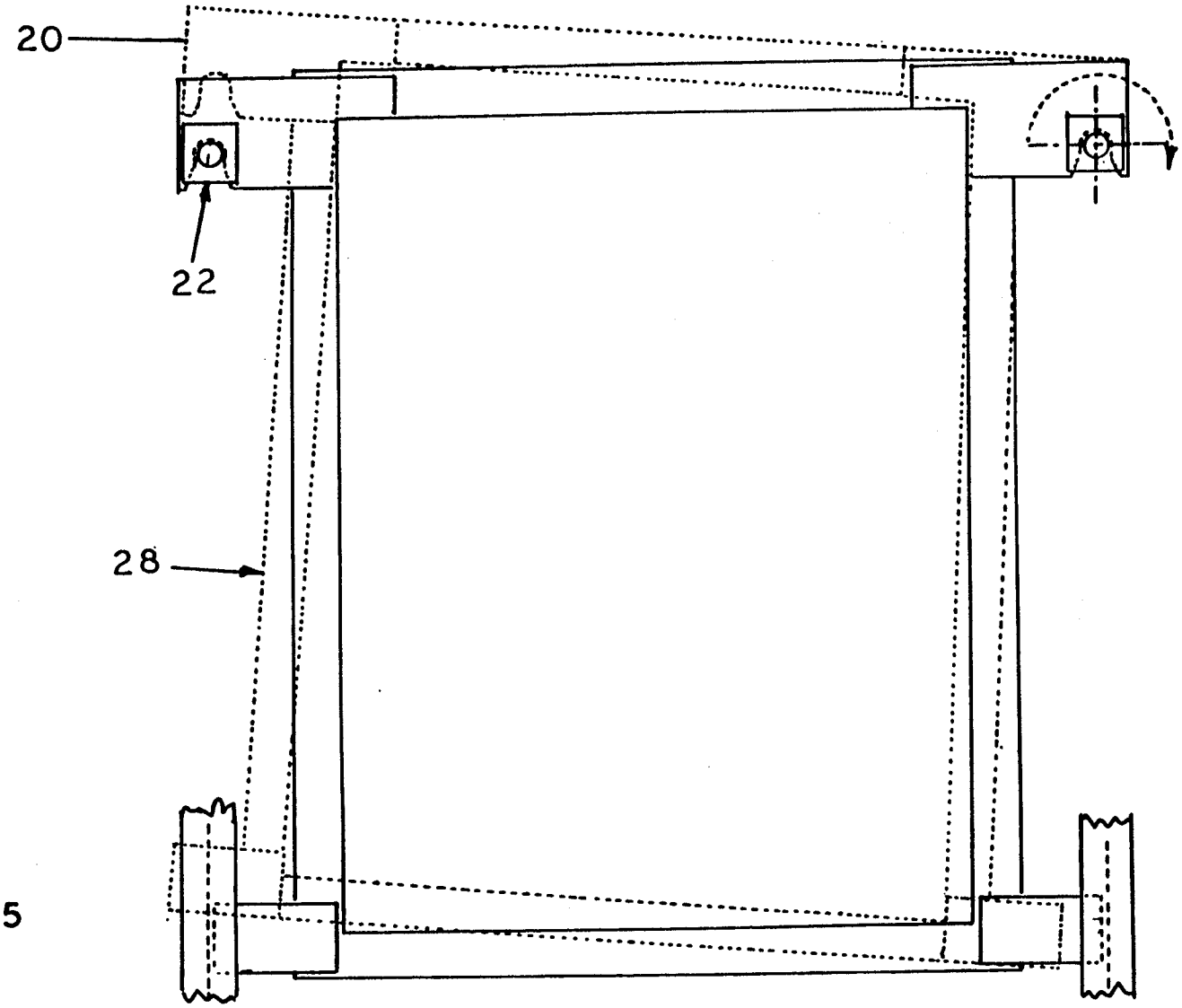
FIG. 5 shows the gate lock causing jambing.

The baby cannot open the gate from a position inside the crib because of the gate locks, 20, 22. 20 is a sheet of rigid material with a half circle hole whose center is located in the lower quarter of the material and opened to the bottom and is rigidly attached to the gate, 28. 22 is a cylindrical dowel pin rigidly attached to the front posts, 21, and to a square of rigid material. Their combination requires an upward movement to unlock and the amount of upward movement required is the same as the size of the said square of rigid material. The said square can be given such dimensions so that before a movement adequate to unlock can be made, the gate guides, 25, will jamb in the gate slides, 26. This jambing action is illustrated in FIG. 5.

The gate, 28, cannot fall on a parent's feet because the foot protector, 27, guards the space where the gate touches the floor. The gate, 28, is restrained from rising too high and falling inside the crib by the stops, 24, and the gate guides, 25.

CRIB COMPARISON

For safety reasons the Consumer Products Safety Commission regulations require full size baby crib mattresses to be at least 27¼ inches wide, 51⅝ inches long, with a thickness not exceeding 6 inches. As average to good quality mattresses vary between 5 and 6 inches thick, a thickness of 5½ inches was used throughout this application and for crib comparison below for both the standard cribs and the 26–36 Crib.

Figure 7:
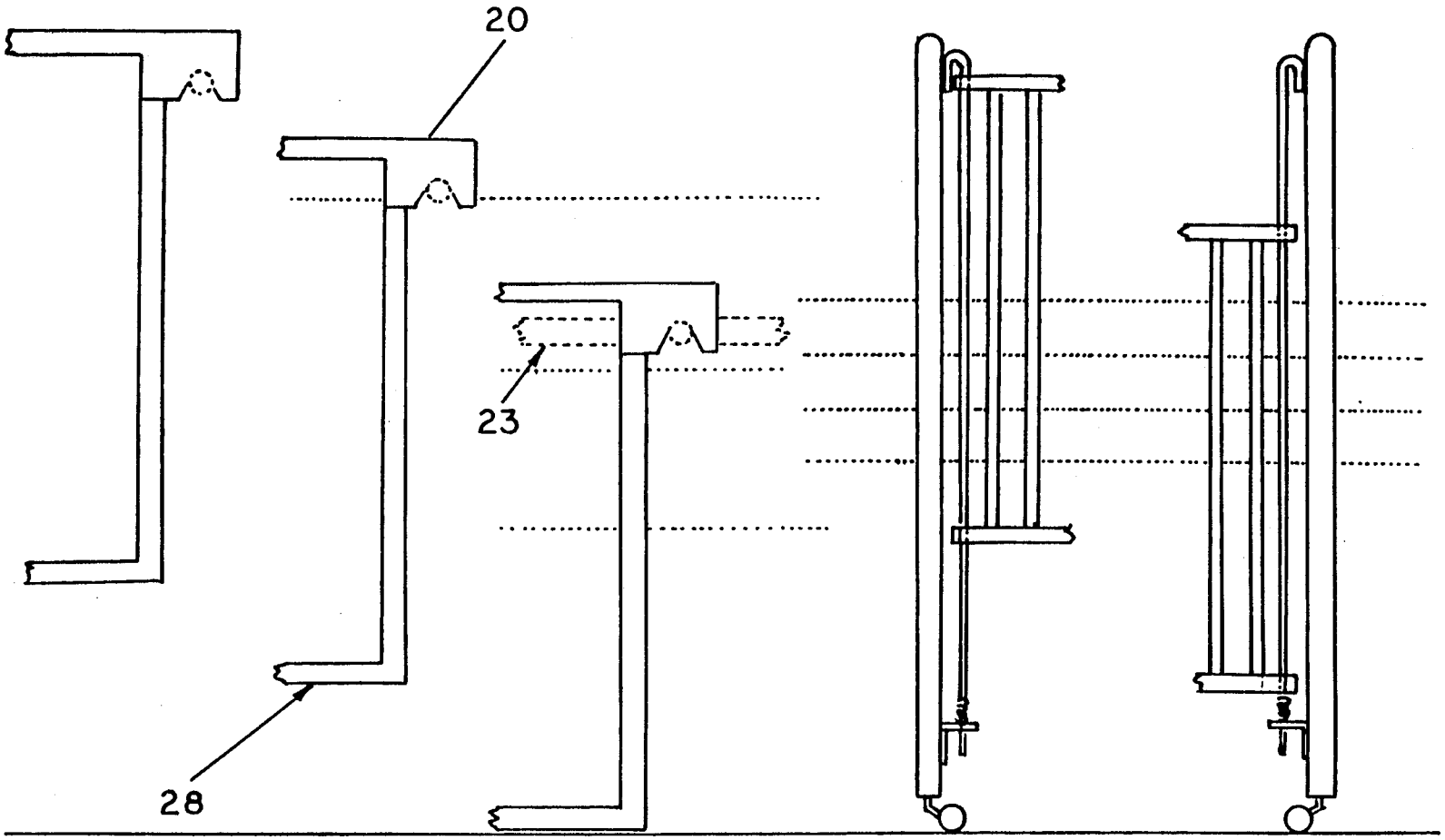
PRIOR ART FIG. 7
FIG. 7 is a comparison of functional fundamentals, 26-36 Crib versus standard crib.

Following is a comparison of the functional fundamentals of the two cribs and it is repeated in drawing form in FIG. 7:

| Mattress Position | Top of Mattress to Floor | Range of Vertical Adjustment | Gate Down Protection | Gate Up Protection | Gate Height |
|---|---|---|---|---|---|
| | 26–36 CRIB (Approximate Dimensions, Inches) | | | | |
| H | 36 | | 3½ | 9 | 31½ |
| M | 26½ | 17 | 5 | 18½ | |
| L | 19 | | 12½ | 26 | |
| | AVERAGE OF 21 NEW STANDARD CRIBS FROM 11 MANUFACTURERS, (Inches) (Stork Craft, Child Craft, Delta Ent. Walt Disney, Evenflo, Child Line, Bassett, Okla Homer Smith, Babycraft, Nelson, Bo-Peep) | | | | |
| H | 29.9 | | 5.4 | 11.4 | 28.1 |
| MH | 27.1 | 8.8 | 8.2 | 14.3 | |
| ML | 24.2 | | 11.1 | 17.5 | |
| L | 21.1 | | 14.0 | 20.6 | |

We claim:

1. An article of furniture which is a full size rectangular baby crib comprising:

(a) four generally upright posts placed in positions inboard from the four outside corners and on a line defining the two long sides of said crib as a means for cantilevering two balcony type modules at each end of said crib, and (b) on any side of said crib containing a gate a plurality of stabilizers to make said posts rigid wherein each of said stabilizers also performs a second function in said crib, and (c) the said gate whose width is less than the length of said crib and which slides vertically to touch or nearly touch the floor, and (d) no part of said crib restricts the vertical motion of said gate from its top at the top railing to its bottom touching or nearly touching the floor, and (e) means on the posts adapted to support the total weight of a mattress support in a plurality of vertically spaceable positions, whereby this type of construction provides the means for vertical mattress adjustments about double those available in standard cribs which permits superior function in parent convenience and baby safety when compared to said standard cribs of long standing.

2. The article of furniture of claim 1 wherein the mattress support, 23, serves also as a post stabilizer in each of its vertical positions.

3. The article of furniture of claim 1 wherein a foot protector, 27, serves also as a post stabilizer in its one fixed position near the floor.

* * * * *